US006655771B2

(12) United States Patent
Matsumoto et al.

(10) Patent No.: US 6,655,771 B2
(45) Date of Patent: Dec. 2, 2003

(54) HEAD POSITION DETECTING METHOD, RECORDING HEAD, IMAGE RECORDING APPARATUS AND STORAGE MEDIUM

(75) Inventors: Nobuo Matsumoto, Kanagawa (JP); Seiichi Inoue, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/891,608

(22) Filed: Jun. 27, 2001

(65) Prior Publication Data

US 2003/0001914 A1 Jan. 2, 2003

(30) Foreign Application Priority Data

Jun. 27, 2000 (JP) ..... 2000-192613

(51) Int. Cl.[7] ..... B41J 27/38

(52) U.S. Cl. ..... 347/13; 347/12; 347/19; 347/42

(58) Field of Search ..... 347/19, 13, 180, 347/187, 40, 41, 43, 12, 9, 14, 42

(56) References Cited

U.S. PATENT DOCUMENTS 4,675,696 A * 6/1987 Suzuki ..... 346/46
6,042,213 A * 3/2000 Hayasaki ..... 347/19
6,215,511 B1 * 4/2001 Asako et al. ..... 347/234
6,312,099 B1 * 11/2001 Hawkins et al. ..... 347/42
6,426,765 B1 * 7/2002 Iwasaki et al. ..... 347/12

FOREIGN PATENT DOCUMENTS

JP 4-38589 6/1992

* cited by examiner

*Primary Examiner*—Stephen D. Meier
*Assistant Examiner*—Lam Nguyen
(74) *Attorney, Agent, or Firm*—Whitham Curtis & Christofferson, P.C.

(57) ABSTRACT

The head position detecting method is applicable to recording with a line head including a plurality of short heads which are arranged in a direction of arrangement of recording elements. The method makes relative movements of the line head and a recording medium in a direction perpendicular to the arrangement direction as at least one pair of first and second short heads adjacent to each other which constitute the line head are operated to perform first recording with at least one recording element on an adjacent side of the first short head and second recording with at least one recording element on an adjacent side of the second short head, thereby obtaining a first and/or second recording patterns and detects, from the first and/or second recording patterns obtained, relative first and/or second positions of the first and second short heads adjacent to each other in the arrangement direction and/or the perpendicular direction. The recording head includes a memory for storing data representing a relationship between the second positions. The image recording apparatus implements the method and/or includes the recording head. The storage medium is loaded with a program executing the above method.

11 Claims, 4 Drawing Sheets

HEAD POSITION DETECTING METHOD, RECORDING HEAD, IMAGE RECORDING APPARATUS AND STORAGE MEDIUM

BACKGROUND OF THE INVENTION

This invention relates to the technology of image recording apparatus using a long line head. More particularly, the invention relates to a head position detecting method which detects the relative positions of adjacent short heads in order to record high-quality image using a line head comprising an array of such short heads. The invention also relates to an image recording apparatus which implements the detecting method and a storage medium loaded with a program for implementing the detecting method.

The invention further relates to a recording head in which data representing the relationship among the relative positions detected by the detecting method is stored and an image recording apparatus provided with the recording head as well as a storage medium which is loaded with a program for implementing the sequence of determining the driving timing of each short head by using the data stored in the recording head.

Unexamined Published Japanese Patent Application (JPA) Nos. 9622/1973 and 51837/1979 teach ink-jet recording apparatus of a type in which part of ink is rapidly evaporated by impulse heating so that the resulting force of expansion allows ink drops to be propelled from orifices.

JPA Nos. 50601/1993 and 207956/1999 teach ink-jet recording apparatus of another type in which a diaphragm is provided in an ink chamber and vibrated by static electricity, with a piezoelectric device or otherwise so that ink drops are propelled from nozzles.

These and other types of ink-jet recording apparatus have many advantages such as fairly low price, ease in handling and good image quality and hence are used extensively as printers in various applications.

In such ink-jet printers and various other printers that employ a "recording head" as in thermal printers and dot impact printers, the recording head is usually a short one comprising an array of recording elements and the recording medium at rest is scanned by the recording head which is moved by a carriage in a direction perpendicular to the direction of arrangement of the recording elements and when one scan cycle ends, the recording medium is moved in the direction of arrangement of the recording elements over the distance determined by the number of recording elements in the head and another scan is performed by the same procedure as described above; this process is repeated to record image on the entire surface of the recording medium.

Printers are also known that use a so-called "line head" which has recording elements arranged over a distance to cover the entire length of one side of the recording medium. The major advantage of using the line head is that by merely performing relative movements of the recording medium and the line head in an auxiliary direction perpendicular to the direction of arrangement of the recording elements, the entire region of the recording medium can be scanned with the recording elements to record image on the entire surface of the recording medium. As a result, printers using the line head can accomplish image recording rapidly and by simple operations without movement of the carriage and intermittent transfer of the recording medium.

On the other hand, the line head has several disadvantages such as higher cost, lower yield and reliability than the short head. In addition, if some of the recording elements break, the expensive line head has to be replaced as a unit and this results in high repair cost.

In order to solve these problems of the line head, it has been proposed that a plurality of short heads each having recording elements arranged in one direction (a main scanning direction) be arranged in the main scanning direction [see Examined Japanese Patent Publication (JPB) No. 38589/1992]. The advantages of short heads such as low cost, high yield and reliability are retained by this line head. In addition, if some recording elements break, only the short head having such broken recording elements need be replaced and this contributes to considerable economy in terms of repair cost.

On the other hand, in order to ensure that high-quality image without defects such as streaks (streaky unevenness in density) and clear spots is recorded with the line head comprising an array of short heads, the individual short heads must be positioned exactly enough to give an appropriate or equal pitch of recording elements at each of the joints between adjacent short heads. It goes without saying that the ends of adjacent two short heads which form the joint therebetween need be produced in an extremely precise manner so that the short heads can be positioned exactly. However, the recording elements are arranged at such small intervals (e.g. on a pitch of 20 $\mu$m if the resolution is 1200 dpi) that difficulty is found in arranging many short heads in exact registry in terms of making the end of each short head which forms a joint with that of the adjacent short head, and considerable difficulty is involved in positioning.

In another approach, adjacent short heads may be shifted in the auxiliary scanning direction such that the recording elements near the end of one short head overlap those near the end of the other short head in the main scanning direction. This approach facilitates making the end of each short head which forms a joint with that of the adjacent short head.

However, to know the position of the joint between the adjacent short heads correctly so that the pitch of recording elements (in the main scanning direction) is made equal even in the joint, the appropriate measuring instrument is necessary and after the replacement of some short heads, it is difficult for the user to pinpoint the joint positions.

Further, in order that printing (dot generation) by means of recording elements of individual short heads making up a long line head can be made on one line in the main scanning direction, positional offsets in the auxiliary scanning direction among the recording elements of the individual short heads must be understood exactly.

However, also in this case, the appropriate measuring instrument is necessary to know the positional offsets in the auxiliary scanning direction exactly, and after the replacement of some short heads, it is also difficult for the user to pinpoint the joint positions.

SUMMARY OF THE INVENTION

The present invention has been accomplished under these circumstances and has as a first object providing a head position detecting method that can be applied to a long line head consisting of a plurality of short heads each comprising a unidirectional array of recording elements and by which the relative positions of the recording elements in adjacent short heads (in the main and auxiliary scanning directions), namely, the position of the joint between the short heads (in the main and auxiliary scanning directions) can be detected correctly without using any sophisticated measuring instruments, thereby ensuring that high-quality image having no streaks (unevenness in density) or clear spots can be recorded by means of the long line head, an image recording apparatus which implements the head position detecting method, and a storage medium loaded with software for implementing the position detecting method.

In addition to the first object mentioned above, a second object of the present invention is to provide a recording head in which data representing the relationship among the relative positions detected by the detecting method is stored and an image recording apparatus provided with the recording head as well as a storage medium which is loaded with a program for implementing the sequence of determining the driving timing of each short head by using the data stored in the recording head.

The inventors of the present invention have conducted intensive studies with a view to attaining the first and second objects mentioned above, and found that adjacent short heads are positioned in particular such that the recording elements near the end of one short head overlap those near the end of the other short head in the main scanning direction and selected recording elements are driven in the overlapping area and, if necessary, density adjustment is also performed, for example, by image processing (video signal processing) so as to prevent the deterioration of image quality due, for example, to excessive packing of recording elements in the overlapping area or the error in the pitch of recording elements, thereby providing ease in the registering of short heads.

Subsequently, the inventors of the present invention have also found that the finding as mentioned above requires correctly knowing the relative positions of the recording elements in adjacent short heads (in the main and auxiliary scanning directions), namely, the positions of the recording elements in the joints (in the main and auxiliary scanning directions), but that the relative positions of the recording elements in the main and auxiliary scanning direction can be correctly known by actually printing on a recording medium using the recording elements in each joint between adjacent short heads and preferably by actually printing while properly controlling the recording elements in each joint, whereupon, for example, even after the replacement of some short heads, the user can pinpoint the joint positions. The inventors have thus completed the present invention.

In order to attain the first object described above, the first aspect of the present invention provides a head position detecting method applicable to recording with a line head comprising a plurality of short heads that each have at least one unidirectional array of recording elements and which are arranged in a direction of arrangement of the recording elements, comprising the steps of: making relative movements of the line head and a recording medium in a direction perpendicular to the direction of arrangement of the recording elements as at least one pair of first and second short heads adjacent to each other which constitute the line head are operated to perform first recording with at least one recording element on an adjacent side of the first short head and second recording with at least one recording element on an adjacent side of the second short head, thereby obtaining a first recording pattern; and detecting, from the first recording pattern obtained, relative first positions of the first and second short heads adjacent to each other in the direction of arrangement of the recording elements.

It is preferable that the head position detecting method of the first aspect further comprises the steps of: performing the first recording with the first short head by using a plurality of recording elements on the adjacent side of the first short head, and the second recording with the second short head by using a plurality of recording elements on the adjacent side of the second short head, thereby obtaining a second recording pattern; and detecting, from the second recording pattern obtained, second positions of the first and second short heads adjacent to each other in a direction approximately perpendicular to the direction of arrangement of the recording elements.

In order to attain the first object described above, the second aspect of the present invention provides a head position detecting method applicable to recording with a line head comprising a plurality of short heads that each have at least one unidirectional array of recording elements and which are arranged in a direction of arrangement of the recording elements, comprising the steps of: making relative movements of the line head and a recording medium in a direction perpendicular to the direction of arrangement of the recording elements as at least one pair of first and second short heads adjacent to each other which constitute the line head are operated to perform first recording with a plurality of recording elements on an adjacent side of the first short head and second recording with a plurality of recording elements on an adjacent side of the second short head, thereby obtaining a second recording pattern; and detecting, from the second recording pattern obtained, second positions of the first and second short heads adjacent to each other in a direction approximately perpendicular to the direction of arrangement of the recording elements.

In the head position detecting method of the present invention, the first recording with the first short head and the second recording with the second short head are preferably performed in adjacent areas that differ in a direction perpendicular to the direction of arrangement of the recording elements.

Preferably, the first recording with the first short head and the second recording with the second short head are performed in identical positions in a direction perpendicular to the direction of arrangement of the recording elements.

Preferably, every n-th recording element is operated to perform the second recording with the second short head, n being an integer of at least two.

Preferably, operative recording elements are successively changed in the second recording with the second short head.

In order to attain the second object described above, the third aspect of the present invention provides a recording head which is a line head including a plurality of short heads that each have at least one unidirectional array of recording elements and which are arranged in a direction of arrangement of the recording elements, comprising: a memory for storing data representing a relationship between second positions as obtained by the steps of: making relative movements of the line head and a recording medium in a direction perpendicular to the direction of arrangement of the recording elements as at least one pair of first and second short heads adjacent to each other which constitute the line head are operated to perform first recording with a plurality of recording elements on an adjacent side of the first short head and second recording with a plurality of recording elements on an adjacent side of the second short head, thereby obtaining a second recording pattern; and detecting, from the second recording pattern obtained, the second positions of the first and second short heads adjacent to each other in a direction approximately perpendicular to the direction of arrangement of the recording elements.

Preferably, the data representing the relationship between the second positions is data on a distance between the first and second short heads adjacent to each other.

Preferably, the data representing the relationship between the second positions is data on a difference in driving timing between the first and second short heads adjacent to each other under predetermined recording conditions.

In order to attain the second object described above, the fourth aspect of the present invention provides an image recording apparatus comprising: a line head including a plurality of short heads that each have at least one unidirectional array of recording elements and which are arranged in a direction of arrangement of the recording elements; a scanner for making relative movements of the line head and a recording medium in a direction perpendicular to the direction of arrangement of the recording elements; a recording control device by which during the relative movements by the scanner, at least one pair of first and second short heads adjacent to each other constituting the line head are operated to perform first recording with a plurality of recording elements on an adjacent side of the first short head and second recording with a plurality of recording elements on an adjacent side of the second short head, whereby a second recording pattern for use in detecting second positions of the first and second short heads adjacent to each other in a direction approximately perpendicular to the direction of arrangement of the recording elements is obtained; a memory for storing data representing a relationship between the second positions that were detected from the second recording pattern obtained by the recording control device; and a timing determining device for determining a driving timing for each short head by using the data representing the relationship between the second positions stored in the memory; wherein the recording control device drives the plurality of short heads at the driving timing determined by the timing determining device when the scanner moves the recording medium relatively.

In order to attain the first object described above, the fifth aspect of the present invention provides an image recording apparatus comprising: a line head comprising a plurality of short heads that each have at least one unidirectional array of recording elements and which are arranged in a direction of arrangement of the recording elements; a scanner for making relative movements of the line head and a recording medium in a direction perpendicular to the direction of arrangement of the recording elements; and a recording control device by which during the relative movements by the scanner, at least one pair of first and second short heads adjacent to each other constituting the line head are operated to perform first recording with at least one recording element on an adjacent side of the first short head and second recording with at least one recording element on an adjacent side of the second short head, whereby a first recording pattern for use in detecting relative first positions of the first and second short heads adjacent to each other is obtained.

Preferably, in order to obtain a second recording pattern for use in detecting second positions of the first and second short heads adjacent to each other in a direction approximately perpendicular to the direction of arrangement of the recording elements, the recording control device further performs: the first recording with the first short head by using a plurality of recording elements on the adjacent side of the first short head; and the second recording with the second short head by using a plurality of recording elements on the adjacent side of the second short head.

It is preferable that the image recording apparatus of the fifth aspect further includes a memory which is incorporated into the line head and stores data representing a relationship between the second positions of the first and second short heads adjacent to each other in a direction approximately perpendicular to the direction of arrangement of the recording elements, as detected from the second recording pattern obtained by the recording control device.

In order to attain the first object described above, the fifth aspect of the present invention provides a computer-accessible storage medium for executing an image recording sequence with a line head comprising a plurality of short heads that each have at least one unidirectional array of recording elements and which are arranged in a direction of arrangement of the recording elements, the medium being loaded with a program for executing a first image recording sequence according to which the line head and a recording medium are moved relatively in a direction perpendicular to the direction of arrangement of the recording elements as at least one pair of first and second short heads adjacent to each other constituting the line head are operated to perform first recording with at least one recording element on an adjacent side of the first short head and second recording with at least one recording element on an adjacent side of the second short head, whereby a first recording pattern for use in detecting relative first positions of the first and second short heads adjacent to each other is obtained.

Preferably, the program further executes a second image recording sequence according to which the first recording with the first short head is performed by using a plurality of recording elements on the adjacent side of the first short head, and the second recording with the second short head is performed by using a plurality of recording elements on the adjacent side of the second short head, whereby a second recording pattern for use in detecting second positions of the first and second short heads adjacent to each other in a direction approximately perpendicular to the direction of arrangement of the recording elements is obtained.

In order to attain the second object described above, the seventh aspect of the present invention provides a computer-accessible storage medium which is loaded with a program for executing a sequence of determining a driving timing of each short head by using data representing a relationship between second positions stored in a memory of a recording head when image recording is performed with the recording head which is a line head including a plurality of short heads each having at least one unidirectional array of recording elements and being arranged in a direction of arrangement of the recording elements, and in which the memory previously stores the data representing the relationship between the second positions as obtained by the steps of: making relative movements of the line head and a recording medium in a direction perpendicular to the direction of arrangement of the recording elements as at least one pair of first and second short heads adjacent to each other which constitute the line head are operated to perform first recording with a plurality of recording elements on an adjacent side of the first short head and second recording with a plurality of recording elements on an adjacent side of the second short head, thereby obtaining a second recording pattern; and detecting, from the second recording pattern obtained, the second positions of the first and second short heads adjacent to each other in a direction approximately perpendicular to the direction of arrangement of the recording elements.

DETAILED DESCRIPTION OF THE INVENTION

The head position detecting method, the recording head, the image recording apparatus and the storage medium of the invention are described below in detail with reference to the preferred embodiments shown in the accompanying drawings.

Figure 1A:
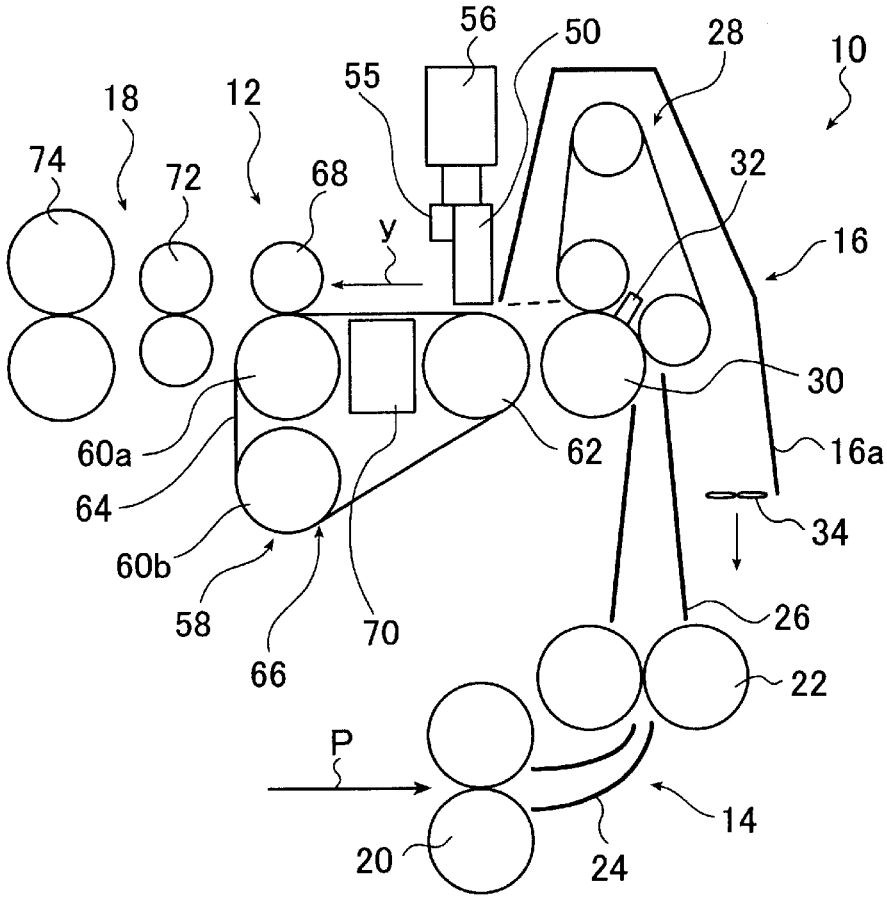
FIG. 1A is a simplified front view of an exemplary ink-jet printer that utilizes the present invention.
Figure 1B:
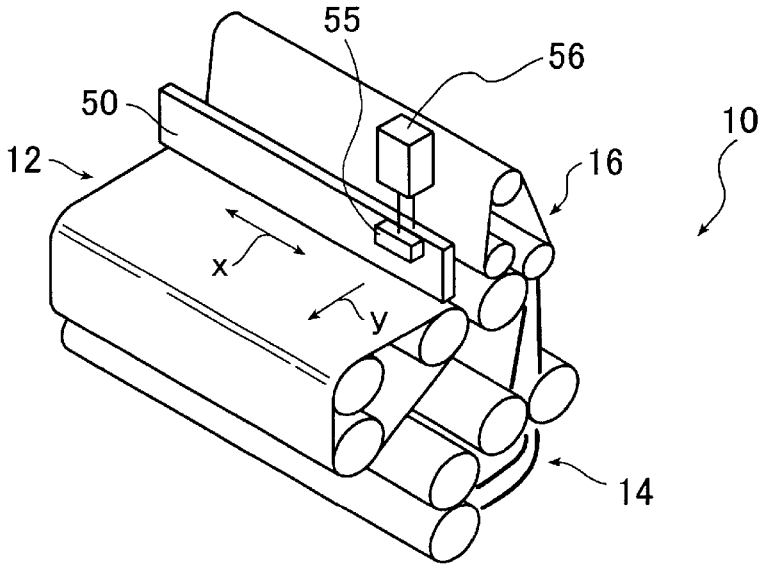
FIG. 1B is a partial simplified perspective view of the same ink-jet printer.

FIGS. 1A and 1B depict an example in which the image recording apparatus according to a fifth aspect of the invention which implements the head position detecting methods according to first and second aspects of the invention are applied to an ink-jet printer. FIG. 1A is a front view showing the structure of the ink-jet printer in conceptual form, and FIG. 1B is a perspective view also showing the same ink-jet printer in conceptual form.

The applicability of the present invention is by no means limited to the ink-jet printer and it is equally applicable with advantage to various modes of image recording (image recording apparatus) such as a dot impact printer, a thermal printer and a sublimation printer that employ a recording head comprising a unidirectional array of recording elements.

The ink-jet printer according to the invention (hereunder referred to simply as "printer") is generally indicated by 10 and it uses an ink-jet recording head (hereunder referred to simply as "recording head") 50 which is a so-called long line head (also referred to as "long head") having ink propelling nozzles 52 (recording elements) arranged over a distance beyond the length of at least one side of a recording medium P having a maximum size that can be handled. The printer 10 is essentially the same as a known ink-jet printer except that the recording head 50 is a line head comprising an array of short heads 54 and that it implements the head position detecting methods according to the first and second aspects of the invention.

A case in which the illustrated printer 10 implements the head position detecting method according to the first aspect of the invention is first described below as a typical example.

The printer 10 shown in FIGS. 1A and 1B comprises a recording section 12 for implementing the head position detecting method according to the first aspect of the invention, a supply section 14, a preheating section 16 and an ejecting section 18 (not shown in FIG. 1B). Needless to say, the printer 10 may further include various known members and units that are installed in various types of ink-jet printers, as exemplified by a maintenance unit primarily intended to clean the recording head 50 and the cap of the recording head 50 for preventing the drying and clogging of nozzles 52.

The supply section 14 has transport roller pairs 20 and 22, as well as guides 24 and 26. The recording medium P such as recording paper is first fed laterally into the supply section 14, through which it is transported upwardly to enter the preheating section 16.

The preheating section 16 has a conveyor 28 consisting of three rollers and an endless belt, a pressure roller 30 that is positioned outside the conveyor 28 and which is inwardly pressed against the endless belt, a heater 32 that is positioned inside the conveyor 28 and which is pressed outwardly against the pressure roller 30 (endless belt), and an evacuation fan 34 for evacuating the interior of the preheating section 16 (its housing 16*a*).

The purpose of the preheating section 16 is to heat the recording medium P prior to ink-jet image recording so that ink propelled onto the recording medium P can be dried (fixed) at accelerated rate. The recording medium P emerging from the supply section 14 enters the preheating section 16, through which it is transported as it is held between the conveyor 28 and the pressure roller 30 and its recording surface is heated with the heater 32 before transport into the recording section 12.

The recording section 12 comprises the recording head 50, a recording control section 56 and a recording medium transport device 58 and it is used to implement the head position detecting method of the invention. The recording head 50 is loaded with ink tanks (not shown). It should be noted that the recording head 50 in a preferred embodiment is provided with a memory 55 for storing the joint positions detected by the head position detecting method of the present invention.

As already mentioned, the recording head 50 is a so-called line head in which ink propelling nozzles 52 are arranged beyond the length of at least one side of the recording medium P having a maximum size that can be handled by the printer 10. In FIG. 1A, the direction of arrangement of nozzles 52 (which is hereunder referred to as the main scanning direction) is normal to the surface of the paper.

Hence, the recording head 50 is such that by making relative movements of the recording head 50 and the recording medium P once in the auxiliary scanning direction which is normal to the main scanning direction, namely, by performing one scan, image can be recorded on the entire surface of the recording medium P. In the illustrated case, image is recorded on the recording medium P as it is transported in the auxiliary scanning direction indicated by arrow y.

The recording head 50 used in the printer 10 of the invention is not a single long ink-jet (recording) head but a plurality of short ink-jet heads (short heads 54) are arranged in the main scanning direction to construct the long recording head 50.

Figure 2:
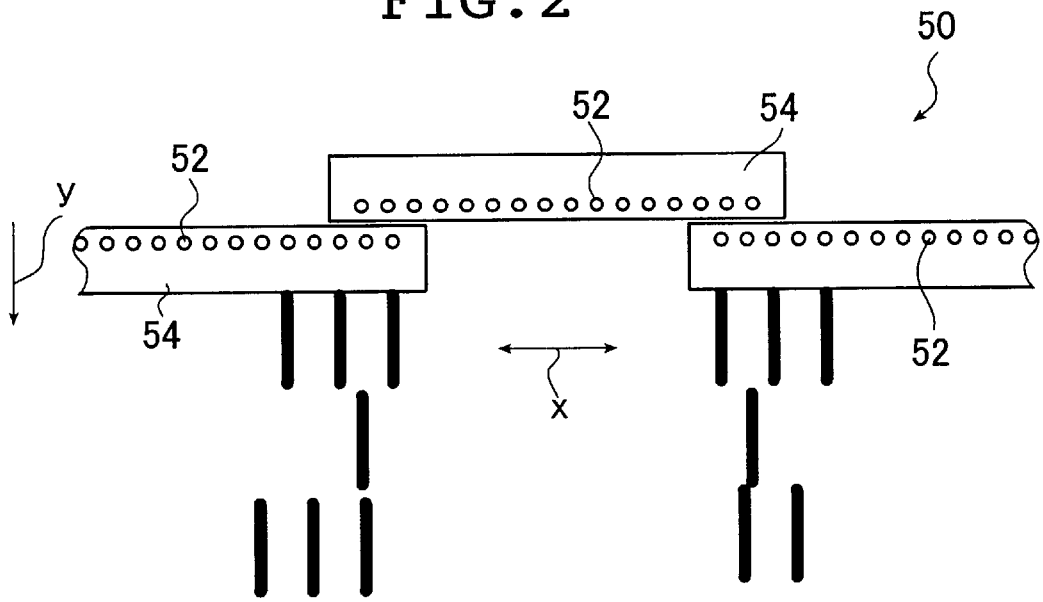
FIG. 2 shows in conceptual form a part of an embodiment of the recording head used in the ink-jet printer shown in FIGS. 1A and 1B.

FIG. 2 shows in conceptual form a plane of the recording head 50 in part as it is seen from the nozzles 52. In the case under consideration, for clarity of the constitution of the invention and the explanation to be given later of the head position detecting method of the invention, it is assumed that the recording head 50 (short head 54) has a single array of nozzles 52 and is adapted to the recording of a monochromatic image.

However, the invention is by no means limited to this particular case and the recording head 50 may be adapted to the recording of a color image by allowing the short heads to have four nozzle arrays, one for propelling K (black) ink, another for M (magenta) ink, yet another for C (cyan) ink and the last for Y (yellow) ink, or more than four nozzle arrays further including those for light C and light M inks. Alternatively, a plurality of recording heads 50 of the type shown in FIG. 2 may be arranged in the auxiliary scanning direction to allow for the recording of color image.

As shown in FIG. 2, the short heads 54 are arranged with partial overlaps but this is not the sole case of the invention and ends of adjacent short heads in the main scanning direction may abut against each other to fabricate a line head.

FIG. 2 shows a preferred embodiment of the invention in which short heads 54 are arranged in the main scanning direction (indicated by arrow x) with at least partial overlaps in the auxiliary scanning direction (indicated by arrow y) so that they will partly overlap as seen in the auxiliary scanning direction. By this arrangement, the recording head 50 to be used in the printer 10 has a prolonged overall nozzle array.

In the recording head 50 according to the preferred embodiment shown in FIG. 2, the short heads 54 are staggered, or alternate in position in the auxiliary scanning direction. This is effective in minimizing the positional offset that may occur to the individual short heads 54 in the auxiliary scanning direction.

As is well known, a line head having nozzles arranged over the enter length of an image-receiving medium has the advantage that there is no need to move the ink-jet head by means of a carriage as in the conventional ink-jet recording apparatus but that a single scan with the line head is sufficient to record image in the entire area of the recording medium P. Hence, the use of this line head enables ink-jet image recording in a rapid and simple operation.

However, a single long line head capable of image recording over the entire length of the shorter side of size A4 is very difficult to fabricate and its production is not only costly but also low in yield.

In the present invention, short heads 54 are arranged in the main scanning direction, with partial overlaps in the auxiliary scanning direction, preferably staggered as shown in FIG. 2. In this way, a long line head can be fabricated using the conventionally manufactured ink-jet head and this offers considerable benefit in many aspects such as productivity, cost and yield. The error in image density due to the positional offsets of the individual short heads 54 in the auxiliary scanning direction can be easily corrected by a suitable method such as delaying video signals.

In the recording head 50 according to the preferred embodiment shown in FIG. 2, the short heads 54 are arranged in such a way that there is an overlap between adjacent short heads for at least one nozzle near their end in the auxiliary scanning direction. This contributes to preventing not only the dropout of recording elements over the entire length of the recording head 50 in the main scanning direction but also the deterioration of image quality such as white streaks running in the auxiliary scanning direction.

In order to record high-quality image with the head 50, it is also necessary to have accurate knowledge of where the joint between adjacent short heads 54 is positioned and to this end the head position detecting method of the invention is utilized advantageously.

This point will be described below in detail.

In the present invention, short heads 54 may employ a variety of known ink-jet heads, including a top shooter head (face ink-jet head), a side shooter head (edge ink-jet head), a thermal ink-jet head which propels ink upon heating. Also useful are ink-jet heads which use a piezoelectric device, static electricity and so forth to vibrate a diaphragm so as to produce a sufficient force to propel ink.

The thermal ink-jet heads described in detail in JPA Nos. 71888/1994, 297714/1994, 227967/1995, 20110/1996, 207291/1996 and 16242/1998 are used with particular advantage. In these ink-jet heads, a drive LSI for applying electric pulses and a thin-film heater for heating and propelling ink are formed on the same silicon (Si) substrate and this has led to the accomplishment of heretofore unattainable compactness, high thermal efficiency and durability. In addition, using the semiconductor fabrication technology, the ink-jet heads can be manufactured in the same manner as Si chips, so the products have very high precision and feature good productivity.

As FIG. 1A shows, the recording control section 56 is connected to the recording head 50. In all phases of image recording including the practice of the head position detecting method of the invention, the ink propulsion from the individual nozzles 52 in the recording head 50 is controlled by the recording control section 56.

The recording medium transport device 58 comprises: a conveyor 66 consisting of rollers 60*a*, 60*b* and a suction roller 62, as well as a perforated endless belt 64; a nip roller 68 (omitted from FIG. 1B) that is pressed against the perforated endless belt 64 (roller 60*a*); and a suction box 70 provided within the space defined by the conveyor 66.

The recording head 50 is positioned in such a way that the nozzles 52 are arranged in the main scanning direction which is normal to the surface of the paper on which FIG. 1A is drawn whereas the nozzles 52 themselves are directed toward the suction roller 62. The recording medium transport device 58 transports the recording medium P continuously at a specified speed in the auxiliary scanning direction (indicated by arrow y) which is perpendicular to the main scanning direction of the recording head 50. Hence, the recording medium P supplied from the preheating section 16 is scanned over the entire surface by the recording head 50 (line head) as image is recorded with the ink being propelled from the nozzles 52.

The conveyor 66 which is composed of the perforated endless belt 64 surrounds the suction roller 62 and the suction box 70. Hence, the recording medium P is transported as it is sucked onto the perforated endless belt 64 and image is recorded as it is held in an appropriate specified position relative to the recording head 50.

After image recording, the recording medium P is supplied to the ejecting section 18, where it is transported by transport roller pairs 72 and 74 to be ejected, for example, into an ejector tray (not shown).

As already noted, the recording head 50 shown in FIG. 1A is a line head composed by an array of short heads 54. In order to record high-quality image with this line head, the individual short heads 54 have to be arranged with precise registry in the position of nozzles 52. However, nozzles 52 are spaced so closely, for example, on a pitch of 20 $\mu$m if the resolution is 1200 dpi that considerable difficulty is encountered in arranging the short heads 54 while securing precise registry in the position of the nozzles.

In the illustrated recording head 50, adjacent short heads 54 are arranged with low accuracy in registration such that there is an overlap in the auxiliary scanning direction for at least one nozzle 52 near the ends of the two short heads in the main scanning direction and, in addition, selected nozzles 52 are driven or operated in the overlapping area to propel ink and, if necessary, density adjustment is also performed, for example, by image processing (video signal processing) so as to prevent the deterioration of image quality due, for example, to excessive packing of nozzles 52 in the overlapping area or the error in the pitch of nozzles 52, thereby eliminating the need to perform very precise registering of the short heads 54.

To this end, the relative positions of the nozzles 52 in adjacent short heads 54, particularly at their ends in the main scanning direction and nearby areas, namely, the position of the joint between opposed recording elements in adjacent short heads 54 must be known precisely.

According to the invention, at least one pair of adjacent short heads 54 are operated in such a way that recording is performed with the nozzles 52 near the adjacent end of one short head 54 in the main scanning direction (which end is hereunder referred to simply as the end) and with the nozzles 52 near the end of the other short head 54, and the recorded image patterns are read to determine (detect) the position of the joint between short heads 54.

Thus, the recording head 50 of the invention which is a line head constructed by arranging short heads 54 in the specified manner in the main scanning direction has the advantage that the positions of the joints can be determined without using any special device such as a sophisticated measuring instrument and operations including adjustment of the recording head 50 before shipment from the factory, as well as determination of joint positions and adjustment of the recording head 50 after partial replacement of short heads 54 by the user can be greatly simplified.

Figure 3:
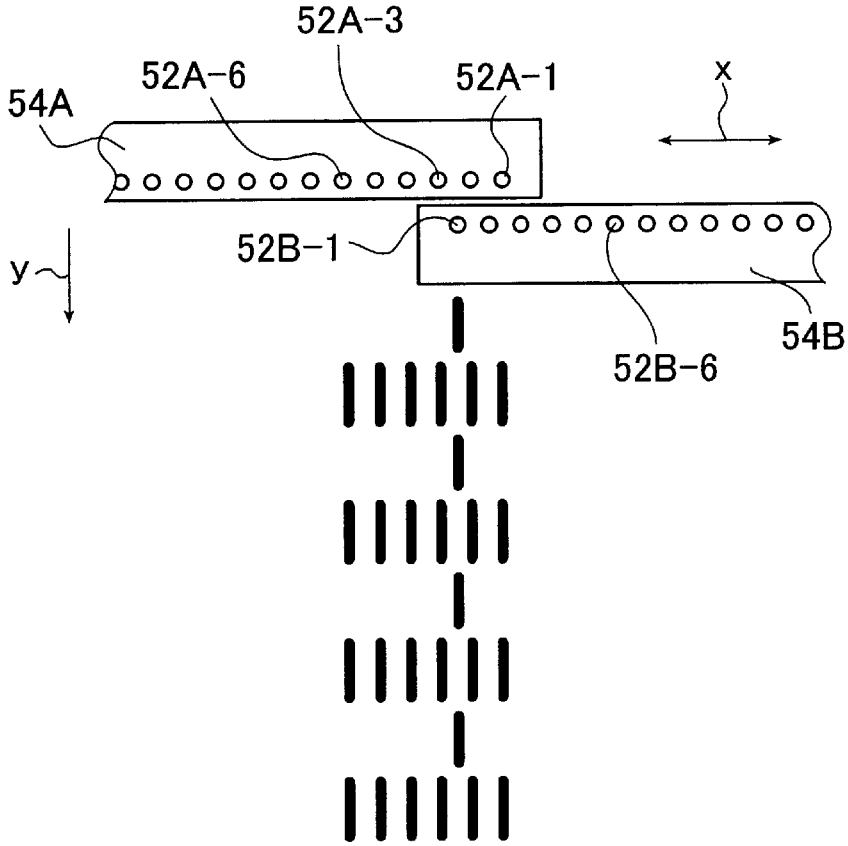
FIG. 3 shows in conceptual form an example of the image recording involved in the head position detecting method of the invention.

FIG. 3 shows an example of this embodiment. In the sequence shown in FIG. 3, recording with at least six nozzles 52 (52A-1 to 52A-6) near the end of the left short head 54A and recording with nozzle 52B-1 at the end of the other short head 54B are alternately performed in neighboring positions that differ in the auxiliary scanning direction.

Figure 4:
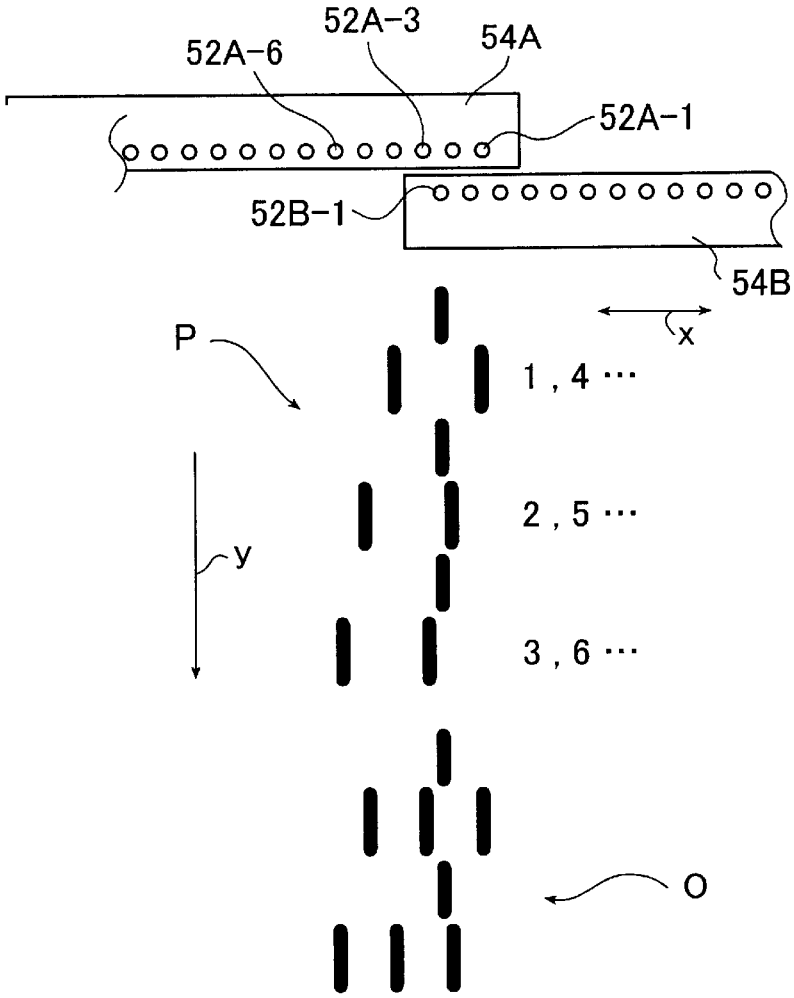
FIG. 4 shows in conceptual form another example of the image recording involved in the head position detecting method of the invention.

In the cases shown in FIGS. 2–4, recording with the short heads 54A and 54B is performed to ensure that the recorded patterns do not overlap at all as seen in the main scanning direction. However, this is not the sole case of the invention and recording with the short heads 54A and 54B may be done in such a way there is partial overlap of the recorded patterns in the main scanning direction.

If one looks at the images obtained by the recording sequence shown in FIG. 3, each of the patterns recorded with nozzle 52B-1 is of course observed between the pattern recorded with nozzle 52A-2 and the pattern recorded with nozzle 52A-3. Hence, by detecting how far the end of each image recorded with the short head 54A is distant from the higher density position in the main scanning direction (by visual measurement or manual measurement with a simple measuring instrument or the like), one can determine that the position of the joint between two short heads 54 is between nozzles 52A-2 and 52A-3 in short head 54A because nozzle 52B-1 at the end of short head 54B lies between 52A2 and 52A-3. Thus, in the case under consideration, the position of the joint between two short heads 54 can be determined with reference to nozzle 52B-1 in short head 54B.

If necessary, a CCD sensor or various other sensors rather than visual check may be used to read image and image analysis (analysis of recorded patterns) performed to determine the position of the joint between short heads.

Therefore, when image is actually recorded (a hard copy is output) with printer 10 in the case under consideration, recording is not performed with nozzle 52A-1 or 52A-2 near the end of short head 54A; in addition, the density of recording with either nozzle 52A-3 in short head 54A or nozzle 52B-1 in short head 54B or both is reduced because these nozzles providing the position of joint between two short heads 54 are spaced on a smaller pitch than usual and would otherwise produce images of higher-than-normal density. By so doing, appropriate image recording can be accomplished.

In the case shown in FIG. 3, recording is done with the six consecutive nozzles 52 (52A-1 to 52A-6) in the end of short head 54A but this would produce such a high image density or recording density in the joint position that it is sometimes difficult to determine which is the high-density position, or the joint position.

In a case like this, it is preferred that not all of the nozzles in the end of non-reference short head 54A are used to record image but only nozzles spaced apart by a given distance are operated and in addition such operative nozzles 52 are successively changed.

An example of this preferred case is shown in FIG. 4. Since the auxiliary scanning direction is indicated by arrow y, the order of recording image patterns in FIG. 4 is from bottom to top. The recorded image patterns on the bottom which are indicated by arrow 0 are obtained by operating every second one out of the at least six nozzles (52A-1 to 52A-6) in the short head 54A. First, nozzles 52A-2, 52A-4 and 52A-6 are operated to record image; thereafter, nozzle 52B-1 at the end of the reference short head 54B is operated to record image; then, nozzles 52A-1, 52A-3 and 52A-5 in the short head 54A are operated to record image; finally, the reference nozzle 52B-1 is operated to record image; this procedure is repeated.

The recorded patterns on the top which are indicated by arrow P are obtained by operating every third one out of the at least six nozzles (52A-1 to 52A-6) in the short head 54A. First, nozzles 52A-3 and 52A-6 are operated to record image; thereafter, nozzle 52B-1 at the end of the reference short head 54B is operated to record image; then, nozzles 52A-2 and 52A-5 in the short head 54A are operated to record image; subsequently, the reference nozzle 52B-1 is operated to record image; then, nozzles 52A-1 and 52A-4 in the short head 54A are operated to record image; finally, the reference nozzle 52B-1 is operated to record image; this procedure is repeated.

The frequency of nozzle actuation in the non-reference short head 54 is by no means limited to the cases shown above and every eleventh one out of the nozzles in the non-reference short head 54 may be operated to record image; all that is necessary is that any appropriate sequence that provides ease in visual checking of density changes be determined in accordance with various factors including the density of arrangement of nozzles 52 in the recording head 50.

In the foregoing cases, the recording with a short head and that with an adjacent short head are performed alternately in different positions in the auxiliary scanning direction; however, this is not the sole case of the invention and the recordings with adjacent short heads may be performed in the same positions in the auxiliary scanning direction.

Figure 5:
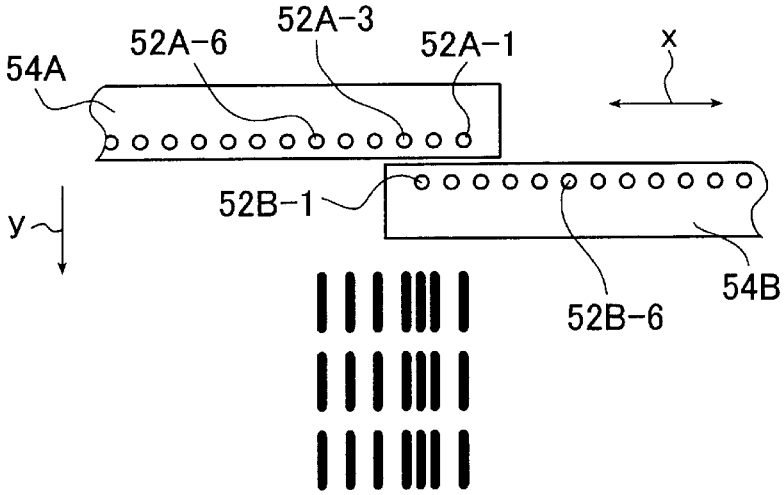
FIG. 5 shows in conceptual form yet another example of the image recording involved in the head position detecting method of the invention.

See, for example, FIG. 5 in which the recording with nozzles 52A-1 to 52A-6 in short head 54A and the recording with nozzle 52B-1 in short head 54B are performed simultaneously and the recorded patterns are read to determine the joint position.

In this method, the (non-reference) nozzles 52A with which the short head 54A records image may of course be changed successively as in the cases shown in FIGS. 2 and 4.

Using the head position detecting method of the invention, image recording operations may sequentially be performed one by one in the position of the joint between adjacent short heads 54. Alternatively, simultaneous recording may be done at a plurality of joints as shown in FIG. 2. In the case shown in FIG. 2, the recording with the first, third, fifth, . . . nozzles in the non-reference short head 54 alternates with the recording with the second, fourth, sixth, . . . nozzles in the same short head.

When performing simultaneous recording in a plurality of joint positions, the patterns recorded in the respective joint positions may be the same or different. If desired, every other short head 54 may be designated the reference head as shown in FIG. 2 or one short head 54 may be operated in such a way that reference recording with only the end nozzle 52 and recording with a specified number of near-end nozzles 52 may be performed at opposite ends of the short head 54.

In the present invention, the nozzles 52A in the non-reference short head 54A (and optionally the reference short head 54B as well) that have been operated to record image may be identified by nozzle number as shown in the region indicated by arrow P in FIG. 4. This provides greater ease in determining joint positions.

Nozzle numbers may be recorded with nozzles 52 that are not operated to perform recording for the purpose of detecting joint positions. Nozzle numbers may be replaced by suitable signs or symbols. Alternatively, a recording medium P dedicated for the detection of joint positions may be provided and preliminarily marked with nozzle numbers or their equivalents.

In the foregoing embodiments, a preferred case is assumed in which recording is performed by referencing to the single nozzle 52 in one of two adjacent short heads 54 which is at the most adjacent end (in the illustrated case, the nozzle is 52B-1) and joint positions are detected from the recorded patterns. But this is not the sole case of the invention and the reference nozzle may be the second or third from the most adjacent end, or recording may be done with a plurality of nozzles 52 in each of the adjacent short heads 54.

Short heads 54 usually have a known and constant nozzle pitch. Therefore, if it is known which nozzle 52 in one of adjacent short heads 54 has propelled ink and between which nozzles 52 in the other adjacent short head 54 that nozzle is located, one can determine the joint position.

Although the foregoing embodiments are sufficient to tell between which nozzles 52 is located the position of a joint of interest, the head position detecting method of the invention allows for knowing greater details about the joint position by performing the above described recording operations after moving the recording head 50 in the main scanning direction.

In the case described below, there is no particular on the method of moving the recording head 50 and various known methods can be employed, as exemplified by the use of a piezoelectric device.

Reference should be made to FIG. 3. First, the sequence shown in FIG. 3 for the case of image recording without moving the recording head 50 is performed by a specified amount. As already mentioned, this enables the operator to know between which nozzles 52 is located the position of a joint of interest.

Subsequently, recording is done with the reference nozzle 52B-1 in the position from which the recording head 50 has not been moved (which is hereunder referred to as the "reference position"); then, the recording head 50 is moved in the main scanning direction (say, to the right) by a small amount (no greater than the nozzle pitch of short head 54) and nozzles 52A-1 to 52A-6 in the other short head 54A are operated to record image; the recording head 50 is returned to the reference position and recording is done with nozzle 52B-1; the procedure is repeated and the sequence of these steps is performed by a specified amount.

A plurality of such sequences are performed with the recording head 50 being moved in varying amounts, preferably in increasing amounts.

According to this image recording method, the image density in the joint position varies with the amount of movement of the recording head 50 and, in the case under consideration, patterns in a straight line are recorded when the positions of nozzles 52A-3 and 52B-1 agree in the main scanning direction. The amount of head movement corresponds to the pitch of nozzles in the joint position and, in the case shown in FIG. 3, is a basis for determining the pitch between nozzles 52A-3 and 52B-1.

In the head position detecting method of the invention, the length of a single record in the auxiliary scanning direction that is obtained by operating each nozzle 52 (i.e., the length of a line recorded with each of the nozzles 52 near the end of each of the short heads shown in FIGS. 3 and 4) is not limited to any particular value but is preferably in the range of 0.1–100 mm in order to determine the correct joint position.

In all the embodiments described above, the joint position is determined by detecting the image area of increased density. Conversely, a solid image (of uniform density) may be recorded, with the inoperative nozzles (which do not perform recording) being successively changed to produce an area of the least density, which is determined as the joint position.

As already mentioned, after detecting the joint position by the method of the invention, it is necessary to select inoperative nozzles 52 (which are nozzles 52A-1 and 52A-2 in the case shown in FIG. 3) and determine the conditions for density adjustment at the nozzles 52 that provide the joint position (nozzle 52A-3 in short head 54A and nozzle 52B-1 at the end of short head 54B in the case shown in FIG. 3).

Various methods can be used to determine the conditions for density adjustment and according to a preferred example, actual image is recorded as the density of recording with the nozzles 52 that provide the joint position is adjusted to varying values and the conditions for density adjustment are determined using as a parameter the density at which the most appropriate image has been recorded.

The case as mentioned above was directed to the method in which, in the long recording head 50 comprising an array of short heads 54 in the main scanning direction, the position of the joint between adjacent short heads 54 in the main scanning direction, namely in the direction in which the nozzles 52 are arranged is pinpointed and detected correctly. However, the head position detecting method of the invention is not limited to this case, but the position of each short head 54 in the array of short heads 54 in the auxiliary scanning direction, namely the position of the nozzles 52 of each short head 54 in the auxiliary scanning direction, or the positional offset between adjacent short heads may be detected.

The head position detecting method according to the second aspect of the present invention in which the positions of individual short heads of a recording head in the auxiliary scanning direction or the positional offsets among the short heads are detected is described below.

Figures 6, 7A, 7B, 7C, 7D, 7E, 7F, 7G, 7H, 7I, 7J:
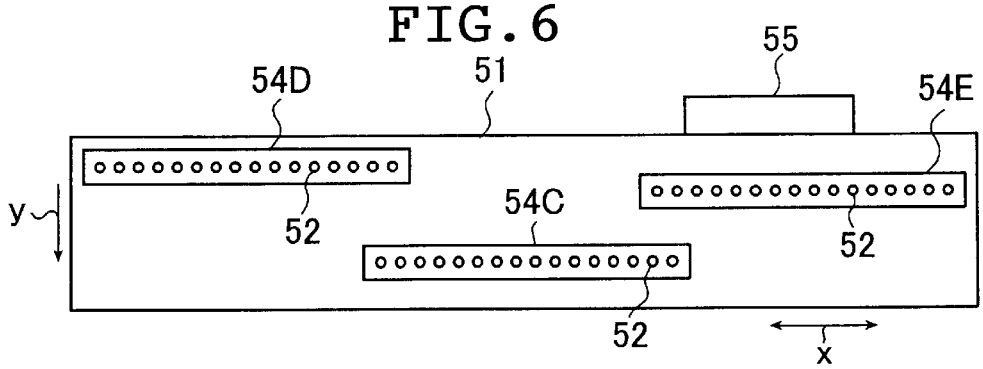
FIG. 6 shows in conceptual form another embodiment of the recording head used in the ink-jet printer shown in FIGS. 1A and 1B.
FIGS. 7A to 7J each show an example of the image recording involved in the head position detecting method of the invention using the recording head shown in FIG. 6.

We first refer to a recording head of which the arrangement is shown in FIG. 6 for use in explaining the head position detecting method according to the second aspect of the present invention.

The recording head 51 shown in FIG. 6 is used instead of the recording head 50 shown in FIGS. 1A and 1B and three short heads 54C, 54D and 54E are staggered in the main scanning direction indicated by arrow x so that at least one nozzle 52 of one short head overlaps that of the adjacent short head. The arrangement of the recording head 51 shown in FIG. 6 is as follows: The short head 54C is located in the center portion; the short head 54D is located on the left side in FIG. 6 and spaced apart by a given distance behind the short head 54C in the auxiliary scanning direction (in which the image-receiving medium is transported) indicated by arrow y; and the short head 54E is located on the right side in FIG. 6 and also behind the short head 54C in the auxiliary scanning direction indicated by arrow y but in a more advanced position than the short head 54D. Further, the recording head 51 is also provided with a memory 55 as in the recording head 50 shown in FIGS. 1A and 1B.

For the sake of simplification, only three short heads 54C, 54D and 54E are arranged in the recording head 51 shown in FIG. 6 and the number of the nozzles 52 in each short head 54 is sixteen. However, this is not the sole case of the present invention and any number of short heads may be arranged, or the short heads may be arranged in any form, or each short head 54 may include any number of nozzles 52.

In the head position detecting method according to this aspect, the recording head 51 shown in FIG. 6 is first mounted on the printer 10 shown in FIGS. 1A and 1B instead of the recording head 50. Then, ink is propelled from the individual nozzles 52 of each short head 54 of the recording head 51 while the recording control section 56 controls the driving timing of each of the short heads 54C, 54D and 54E in the recording head 51 with varying values, whereby printing is performed on the recording medium P being transported by the recording medium transport device 58 in the auxiliary scanning direction indicated by arrow y. Test printing, that is, image (dot) recording is thus performed by means of the recording head 51.

Examples of the results obtained are shown in FIGS. 7A–7J.

FIG. 7A shows an exemplary test print obtained by printing while simultaneously driving the short heads 54C, 54D and 54E.

FIG. 7B shows an exemplary test print obtained by printing while simultaneously driving the short heads 54D and 54E faster than the short head 54C by a specified time of period, for example by "b" μs.

FIG. 7C shows an exemplary test print obtained by printing while simultaneously driving the short heads 54D and 54E faster than the short head 54C by a specified time of period which is longer than that shown in FIG. 7B, for example by "c" μs (c>b)

FIG. 7D shows an exemplary test print obtained by printing while simultaneously driving the short heads 54D and 54E faster than the short head 54C by a specified time of period which is longer than that shown in FIG. 7C, for example by "d" μs (d>c)

FIG. 7E shows an exemplary test print obtained by printing while driving the short heads 54D and 54E faster than the short head 54C by "d" μs and "c" μs, respectively.

FIG. 7F shows an exemplary test print obtained by printing while driving the short heads 54D and 54E faster than the short head 54C by "f" μs (f>d) and "c" μs, respectively.

FIG. 7G shows an exemplary test print obtained by printing only with the nozzles in the overlapping portions of the individual short heads 54 while simultaneously driving the short heads 54C, 54D and 54E.

FIG. 7H shows an exemplary test print obtained by printing only with the nozzles in the overlapping portions of the individual short heads 54 while simultaneously driving the short heads 54D and 54E faster than the short head 54C by "b" μs.

FIG. 7I shows an exemplary test print obtained by printing only with the nozzles in the overlapping portions of the individual short heads 54 while simultaneously driving the short heads 54D and 54E faster than the short head 54C by "c" μs.

FIG. 7J shows an exemplary test print obtained by printing only with the nozzles in the overlapping portions of the individual short heads 54 while simultaneously driving the short heads 54D and 54E faster than the short head 54C by "d" μs.

The results obtained from FIGS. 7C, 7E and 7I show that it is preferable to drive the short head 54E faster than the short head 54C by "c" μs.

Further, FIGS. 7D, 7E and 7J show that it is preferable to drive the short head 54D faster than the short head 54C by "d" μs.

Furthermore, FIG. 7E or the results obtained above show that it is preferable to drive the short heads 54E and 54D faster than the short head 54C by "c" μs and "d" μs, respectively.

As a result, by driving the short heads 54E and 54D faster than the short head 54C by "c" μs and "d" μs, respectively in recording with the recording head 51 shown in FIG. 6, one can prevent positional offsets in the auxiliary scanning direction that may be found in the joint positions of the individual short heads 54 of the recording head 51 when recording one line in the main scanning direction and deterioration of image quality such as density unevenness in a recorded image found in the main scanning direction and streaks that run in the auxiliary scanning direction in the joint positions due to the density unevenness.

Thus, the joint positions in the auxiliary scanning direction of the individual short heads 54 arranged in the recording head 51 can be detected as differences in the driving timing in the nozzles 52 of the individual short heads 54.

Hence, the recording head 51 is capable of test printing on the entire surface of the recording medium P as shown in FIG. 7A–FIG. 7F by making relative movements of the recording head 51 and the recording medium P once in the auxiliary scanning direction perpendicular to the main scanning direction while changing the driving timing for each short head 54, more specifically at least for a plurality of nozzles 52 in each joint between adjacent short heads 54, namely by performing one scan while changing the driving timing for each short head 54.

A plurality of types of test printing which apply varying driving timings to the nozzles 52 of the individual short heads 54 in the recording head 51, for example those as shown in FIG. 7A–FIG. 7J or FIGS. 7A–7F or 7G–7J may be performed by making relative movements of the recording head 51 and the recording medium P once in the auxiliary scanning direction, namely by performing one scan so that the joint positions of the individual short heads 54 in the auxiliary scanning direction can be detected based on the printing results obtained. Alternatively, after performing at least one type of test printing by one scan, test printing may be repeatedly performed by further scanning depending on the printing results until the joint positions of the individual short heads 54 in the auxiliary scanning direction can be detected.

When detecting the joint positions of the individual short heads 54 in the auxiliary scanning direction by one scan, test printing to be performed has no particular limitation on the type and the number of types to be printed. Any types or any timings may be combined and the timing may be delayed by any time of period. Further, test printing may be performed any times.

When performing test printing repeatedly, the number of repetitions, the type of test printing applied and the number of types to be printed are also not limited in any particular way.

The approximate differences in the driving timing may be calculated prior to test printing by using the auxiliary scanning speed from the positional offsets of the individual short heads 54 of the recording head 51 in the auxiliary scanning direction that were measured approximately such that the delay time in the driving timing to be changed in test printing can be determined.

In the case mentioned above, the positional offsets of the individual short heads 54 of the recording head 51 in the auxiliary scanning direction are detected as the differences in the driving timing, but the present invention is not limited to this case. The auxiliary scanning speed or the like upon detection may be employed to convert the differences in the driving timing into the actual positional offsets (distances) to be detected.

This facilitates correct detection of the positional offsets in the auxiliary scanning direction which has been heretofore difficult.

The head position detecting method according to the second aspect of the invention is constituted as described above.

In the cases as described above, the head position detecting methods according to the first and second aspects of the invention separately detect the joint positions, namely nozzle positions of the individual short heads of the recording head in the main and auxiliary scanning directions, respectively. However, the invention is not limited to these cases, and the positions in the main scanning direction and those in the auxiliary scanning direction may be both detected simultaneously or in combination. To be more specific, test printing as shown in FIG. 3 or FIG. 4 and at least part of test printing as shown in FIG. 7A–FIG. 7J may be performed by one scan (one print process) on one recording medium P in a consecutive manner. Alternatively, both types of test printing may be performed simultaneously in combination by more than one scan (more than one print process). In the present invention, the printing sequence and number of printings in both types of test printing are not limited in any particular way but can be appropriately selected as required.

By performing both types of test printing simultaneously or in combination, the joint positions of the individual short heads of the recording head in the main and auxiliary scanning directions can be detected correctly and easily at a time.

When detecting the joint positions of the individual short heads 54 and particularly the positions thereof in the auxiliary scanning direction in the recording head 50 or 51, test printing of recording patterns as shown in FIGS. 3, 4 and 7A–7J may be performed by one print process or more than one print process. However, it is preferable to perform test printing once or by one print process in order to reduce the effect on shifting of the relative positions of the recording head 50 or 51 and the recording medium P.

It is preferable that at least one of the joint positions of the individual short heads of the recording head as detected in the main and auxiliary scanning directions is stored in the memory 55 provided in the recording head 50 or 51. This arrangement facilitates setting of the conditions for density adjustment in printing with ink propelled from the nozzles 52 in each joint between adjacent short heads 54 in the main scanning direction as well as driving timing of the nozzles 52 of each short head 54 in the auxiliary scanning direction by reading out the joint positions of the individual short heads 54 in the main scanning direction and the positions of the individual short heads 54 in the auxiliary scanning direction from the memory 55 when using the recording head 50 or 51. The memory 55 is preferably of a nonvolatile type such as ROM, EPROM, EEPROM or flash memory.

The recording head according to a third aspect of the invention can retain the detection results of the joint positions in the individual short heads in an incorporated manner, which enables handling only with the recording head. Therefore, there is no need to repeat the head position detecting method of the invention to detect the joint positions, even when the recording head cannot be associated with the detection results due to their absence.

Further, the recording head 50 or 51 according to the third aspect of the invention is applied to the printer 10 shown in FIGS. 1A and 1B. In this case, the recording control section 56 controls ink propelled from the recording head 50 or 51 so as to enable test printing by the head position detecting method according the first aspect of the invention as shown in FIGS. 3 and 4 as well as test printing by that as shown in FIGS. 7A–7J. Thereafter, the joint positions of the individual short heads 54 in the main scanning direction and the positions of the individual short heads 54 in the auxiliary scanning direction that were detected by performing test printing are written in the memory 55.

In a preferred embodiment, when actual image is printed with the recording head 50 or 51 in the printer 10, the recording control section 56 reads out the joint positions of the individual short heads 54 in the main scanning direction and the positions of the individual short heads 54 in the auxiliary scanning direction prior to actual image recording, and also functions for the main scanning direction as a propelling nozzle determining device for determining from which nozzles 52 in each joint between adjacent short heads 54 ink should be propelled for making densities even, for the auxiliary scanning direction as a driving timing determining device for determining the driving timing for each short head 54, and in actual image recording as a density adjusting device for controlling ink propelled from the individual nozzles 52 of the short heads 54 or a timing control device for controlling the propelling timing.

Thus, it is preferable that the image recording apparatus according to the fourth and fifth aspects of the invention do not only implement the head position detecting methods according to the first and second aspects of the invention but also determine nozzles 52 from which ink is propelled in each joint between adjacent short heads 54 and the propelling timing based on the detection results as well as adjust recording densities for the determined nozzles or control the driving timing at the determined timing values.

In the present invention, the joint positions of the individual short heads 54 of the recording head 50 or 51 in the main or auxiliary scanning direction are stored in the memory 55 provided in the recording head 50 or 51. However, these joint positions may be stored in a recording medium separate from the recording head if they can be associated with the recording head for example by means of ID or the like.

The recording head according to the third aspect of the invention and the image recording apparatus according to the fourth and fifth aspects of the invention are basically constituted as described above.

The foregoing description concerns the recording of monochromatic image. If the present invention is to be applied to a color printer, the head position detecting method of the invention may be performed on all colors involved such as Y, M, C and K, or alternatively, the method may be implemented for only one color and the operator follows suit for the other colors.

This alternative approach is particularly effective in the already-mentioned case where one short head has a plurality of nozzle arrays for different colors because the relative positions of the nozzle arrays in the main scanning direction have been determined with high precision in the production stage and implementing the head position detecting method of the invention for one color usually suffices for knowing the exact relative positions of the nozzles for the respective colors.

Next, according to its sixth aspect, the invention provides a computer-accessible storage medium that is loaded with a program for implementing the above-described head position detecting methods according to the first and second aspects of the invention by executing the image recording procedures depicted in FIGS. 3, 4 and 7. That is, in the illustrated cases, this is a storage medium loaded with a program by which the recording head 50 or 51 comprising a plurality of short heads 54 arranged in the main scanning direction executes an image recording sequence with at least one pair of adjacent short heads 54 which consists of recording with only the nozzle 52 at the end of one short head 54 and recording with a specified number of nozzles 52 near the end of the other short head 54.

The storage medium may be of any type that can be loaded with the program for implementing the head position detecting method of the invention and examples include magnetic storage media such as magnetic tape, floppy disk (FD), hard disk (HD), ZIP, MD and JAZ, magneto-optical storage media such as MO and PD, optical storage media such as CD-ROM, and IC memory such as PC card.

The recording medium according to the sixth aspect of the invention as mentioned above is loaded with a program by which the recording head 50 or 51 executes the image recording sequence as mentioned above. However, this is not the sole case of the invention, and according to its seventh aspect, the invention also provides a computer-accessible recording medium which is loaded with a program for implementing the sequence of determining for the main scanning direction from which nozzles 52 in each joint between adjacent short heads 54 ink should be propelled for making densities even, and the sequence for determining for the auxiliary scanning direction the driving timing for each short head 54, by reading out from the memory 55 the joint positions of the individual short heads 54 in the main scanning direction and the positions of the individual short heads 54 in the auxiliary scanning direction that were detected by executing the image recording sequence as mentioned above in the recording head 50 or 51 and then stored in the memory 55.

While the head position detecting method of the invention, the image recording apparatus for implementing this method and the storage medium loaded with an image recording sequence program for implementing the above method as well as the recording head in which the detection results are stored, the image recording apparatus provided with the recording head and the storage medium loaded with a program for implementing the sequence of determining the driving timing by using the detection results stored in the recording head have been described above in detail, it should be noted that the invention is by no means limited to the foregoing various embodiments and various improvements and modifications can of course be made without departing from the scope and spirit of the invention.

For instance, in the cases shown in FIGS. 2–5, adjacent short heads produce records (lines) of the same length but, if desired, one short head may record lines of a different length than those recorded with the other short head.

As described in detail on the foregoing pages, according to the present invention, the position of each joint between adjacent short heads that make up a line head, namely each joint position in the main scanning direction (in which the short heads are arranged) and each positional offset in the auxiliary scanning direction can be detected correctly without using any sophisticated measuring instruments and, for example even after the replacement of some short heads, the user can pinpoint the joint positions. As a result, the choice of operative recording elements in the line head and the appropriate setting of conditions for density adjustment and driving timing for each short head can be effectively made to enable the recording of high-quality image that is free from density unevenness in the form of streaks and clear spots.

What is claimed is:

1. A head position detecting method applicable to recording with a line head comprising a plurality of short heads that each have at least one unidirectional array of recording elements and which are arranged in a direction of arrangement of said recording elements, comprising steps of:

making relative movements of said line head and a recording medium in a direction perpendicular to the direction of arrangement of said recording elements as at least one pair of first and second short heads adjacent to each other which constitutes said line head are operated to perform first recording with at least one recording element on an adjacent side of the first short head and second recording with at least one recording elements on an adjacent side of the second short head, thereby obtaining a first recording pattern which has a subpattern by the first recording and a subpattern by the second recording both of which are recorded on different positions of the recording medium relative to each other; and detecting a precise position of a joint, from the first recording pattern obtained, between the relative first positions of the first and second short heads adjacent to each other in the direction of arrangement of said recording elements.

2. The head position detecting method according to claim 1, wherein said first recording with the first short head and said second recording with the second short head are performed in adjacent areas that differ in a direction perpendicular to the direction of arrangement of said recording elements.

3. The head position detecting method according to claim 1, wherein said first recording with the first short head and said second recording with the second short head are performed in identical positions in a direction perpendicular to the direction of arrangement of said recording elements.

4. The heading position recording method according to claim 1, wherein every n-th recording element is operated to perform said second recording with the second short head, n being an integer of at least two.

5. The heading position recording method according to claims 1, wherein operative recording elements are successively changed in said second recording with the second short head.

6. The head position detecting method according to claim 1, further comprising the steps of:

performing said first recording with the first short head by using a plurality of recording elements on the adjacent side of the first short head, and said second recording with the second short head by using a plurality of recording elements on the adjacent side of the second short head, thereby obtaining a second recording pattern; and detecting, from the second recording pattern obtained, second positions of the first and second short heads adjacent to each other in a direction approximately perpendicular to the direction of arrangement of said recording elements.

7. An image recording apparatus comprising:

a line head comprising a plurality of short heads that each have at least one unidirectional array of recording elements and which are arranged in a direction of arrangement of said recording elements;

a scanner for making relative movements of said line head and a recording medium in a direction perpendicular to the direction of arrangement of said recording elements; and a recording control device by which during the relative movements by said scanner, at least one pair of first and second shorts heads adjacent to each other constituting said line head are operated to perform first recording with at least one recording element on an adjacent side of the second short head, whereby a first recoding pattern which has a subpattern by the first recording and a subpattern by the second recording both of which are recorded on different position of the recording medium relative to each other for use in detecting a precise position of a joint between the relative first positions of the first and second short heads adjacent to each other is obtained.

8. The image recording apparatus according to claim 7, wherein, in order to obtain a second recording pattern for use in detecting second positions of the first and second short heads adjacent to each other in a direction approximately perpendicular to the direction of arrangement of said recording elements, said recording control device further performs:

said first recording with the first short head by using a plurality of recording elements on the adjacent side of the first short head; and said second recording with the second short head by using a plurality of recording elements on the adjacent side of the second short head.

9. The image recording apparatus according to claim 8, further including a memory which is incorporated into the line head and stores data representing a relationship between the second positions of the first and second short heads adjacent to each other in a direction approximately perpendicular to the direction of arrangement of said recording elements, as detected from the second recording pattern obtained by said recording control device.

10. A computer-accessible storage medium for executing an image recording sequence with a line head comprising a plurality of short heads that each have at least one unidirectional array of recording elements and which are arranged in a direction of arrangement of said recording elements, said medium being loaded with a program for executing a first image recording sequence according to which said line head and a recoding medium are moved relatively in a direction perpendicular to the direction of arrangement of said recording elements as at least one pair of first and second short heads adjacent to each other constituting said line head are operated to perform first recording with at least one recording element on an adjacent side of the first short head and second recording with at least one recording element on an adjacent side of the second short head, whereby a first recording pattern which has a subpattern by the first recoding and a subpattern by the second recording both of which are recorded on different positions of the recording medium relative to each other for use in detecting a precise position of a joint between the relative first positions of the first and second short heads adjacent to each other is obtained.

11. The storage medium according to claim 10, wherein said program further executes a second image recording sequence according to which said first recording with the first short head is performed by using a plurality of recording elements on the adjacent side of the first short head, and said second recording with the second short head is performed by using a plurality of recording elements on the adjacent side of the second short head, whereby a second recording pattern for use in detecting second positions of the first and second short heads adjacent to each other in a direction approximately perpendicular to the direction of arrangement of said recording elements is obtained.

* * * * *